US007997511B2

(12) United States Patent
Reynolds et al.

(10) Patent No.: US 7,997,511 B2
(45) Date of Patent: Aug. 16, 2011

(54) PORTABLE TEXTURE-SPRAYING APPARATUS FOR UNIFORMLY DISPERSING A VISCOUS MATERIAL

(75) Inventors: John Reynolds, Fayetteville, AR (US); Troy Thurber, Bentonville, AR (US)

(73) Assignee: Marshalltown Company, Marshalltown, IA (US)

( * ) Notice: Subject to any disclaimer, the term of this patent is extended or adjusted under 35 U.S.C. 154(b) by 622 days.

(21) Appl. No.: 12/022,782

(22) Filed: Jan. 30, 2008

(65) Prior Publication Data

US 2009/0145978 A1 Jun. 11, 2009

Related U.S. Application Data

(60) Provisional application No. 61/012,641, filed on Dec. 10, 2007.

(51) Int. Cl.
*A62C 15/00* (2006.01)

(52) U.S. Cl. ..... 239/152; 239/153; 239/601; 239/590; 239/290; 239/321; 224/148.1; 224/148.2; 224/148.5; 224/148.6

(58) Field of Classification Search ..... 239/152, 239/153, 308, 290, 590, 601, 321, 323, 329; 224/148.1, 148.2, 148.3, 148.4, 148.5, 148.6, 224/148.7
See application file for complete search history.

(56) References Cited

U.S. PATENT DOCUMENTS

| | | | | | |
|---|---|---|---|---|---|
| 1,334,582 | A | * | 3/1920 | Archibald | 224/181 |
| 1,974,849 | A | | 9/1934 | Harris | |
| 2,606,701 | A | * | 8/1952 | Huthsing | 169/30 |
| 2,692,799 | A | * | 10/1954 | Parrott | 239/152 |
| 2,768,036 | A | * | 10/1956 | Greenough | 277/448 |
| 3,114,486 | A | * | 12/1963 | Flexman | 224/628 |
| 3,164,325 | A | * | 1/1965 | Veum | 239/126 |
| 3,545,342 | A | * | 12/1970 | Hiestand | 92/106 |
| 3,802,511 | A | * | 4/1974 | Good, Jr. | 169/30 |
| 4,174,068 | A | | 11/1979 | Rudolph | |
| 4,197,994 | A | * | 4/1980 | Liedberg | 239/61 |
| 4,199,303 | A | * | 4/1980 | Gusmer et al. | 417/216 |
| 4,751,994 | A | * | 6/1988 | Brown et al. | 194/341 |
| 5,067,591 | A | | 11/1991 | Fehlig | |
| 5,114,054 | A | * | 5/1992 | Watson | 222/389 |
| 5,203,507 | A | * | 4/1993 | Matthews | 239/373 |

(Continued)

FOREIGN PATENT DOCUMENTS

GB 2268165 * 6/1994

*Primary Examiner* — Dinh Q Nguyen
*Assistant Examiner* — Trevor E McGraw
(74) *Attorney, Agent, or Firm* — Keisling & Pieper PLC; Meredith K. Lowry

(57) ABSTRACT

This invention is related to a portable texture-spraying apparatus for uniformly dispersing a viscous material. This apparatus broadly includes a tank assembly having a body with an inner wall that defines a sealed cavity, and a piston assembly slidably disposed within the sealed cavity. The piston assembly divides the sealed cavity into an air-side chamber and a material-side chamber by providing an airtight seal therebetween. Additionally an air-control assembly is provided that broadly includes a pressure-control mechanism configured for receiving compressed air and routing a controlled pneumatic pressure to a directional valve configured for adjusting between a dispensing mode and a loading mode. In dispensing mode, the directional valve routes the controlled pneumatic pressure to the air-side chamber biasing the piston assembly toward the material-side chamber. In loading mode, the directional valve releases the air-side chamber to the atmosphere allowing for filling the material-side chamber with viscous material.

10 Claims, 7 Drawing Sheets

U.S. PATENT DOCUMENTS

| | | | | |
|---|---|---|---|---|
| 5,328,096 | A | 7/1994 | Stenge et al. | |
| 5,558,277 | A | 9/1996 | Owen | |
| 5,779,098 | A * | 7/1998 | Fancher | 222/41 |
| 5,863,146 | A | 1/1999 | Denkins | |
| 6,016,937 | A | 1/2000 | Clay | |
| 6,024,248 | A * | 2/2000 | Fancher | 222/41 |
| 6,039,223 | A | 3/2000 | Damask | |
| 6,196,742 | B1 * | 3/2001 | Tarver, III | 401/5 |
| 6,499,979 | B2 * | 12/2002 | Northup et al. | 425/6 |
| 6,769,628 | B1 * | 8/2004 | Vaage et al. | 239/152 |
| 6,916,025 | B2 * | 7/2005 | Brisson | 277/637 |
| 7,159,508 | B1 * | 1/2007 | Birsner | 92/205 |
| 7,717,354 | B1 * | 5/2010 | Robinson | 239/1 |
| 2002/0175222 | A1 * | 11/2002 | Vaage | 239/153 |
| 2004/0112982 | A1 * | 6/2004 | Dilley | 239/152 |
| 2005/0173132 | A1 * | 8/2005 | Sjostrom | 169/73 |

* cited by examiner

PORTABLE TEXTURE-SPRAYING APPARATUS FOR UNIFORMLY DISPERSING A VISCOUS MATERIAL

CROSS-REFERENCE TO RELATED APPLICATIONS

This application claims priority to commonly owned U.S. provisional application Ser. No. 61/012,641, filed Dec. 10, 2007, incorporated by reference herein.

STATEMENT REGARDING FEDERALLY SPONSORED RESEARCH OR DEVELOPMENT

Not applicable.

BACKGROUND OF THE INVENTION

This invention relates to an apparatus for holding a supply of viscous material (e.g., drywall mud) and dispensing the viscous material to a texture-spraying type gun for applying the viscous material to a support surface (e.g., interior walls and ceilings). More particularly, an improved portable texture-spraying apparatus for uniformly dispersing a supply of viscous fluid according to a controlled pneumatic pressure provided by an integral pressure-control mechanism is disclosed.

Texture-spraying type guns are common in the construction industry. Typically, these guns are fed a viscous material from some form of container or hopper that is directly attached thereto. Further, the guns are adapted to apply the viscous material to treat some surface (e.g., texturing). However, application of the treatment is based on a rate at which the viscous material is fed thereto. This rate may be governed by a manual technique, gravity, or another imprecise source of power. Accordingly, the rate of feed is inconsistent. Consequently, the resultant treatment is uneven, includes obvious blemishes, and usually requires touch-up work. The present invention pertains to a system for regulating the rate of feed such that the gun receives viscous material in a consistent manner thereby greatly reducing these aforementioned problems in the present art.

In addition, the container or hopper directly attached to present guns carries a limited supply of viscous material to reduce operator fatigue. This limited supply extends the time required to perform a specific job due to a need to frequently reload with viscous material, thereby reducing efficiency. Alternatively, guns that are remote from a contained or hopper that can hold a large volume of viscous material lack flexibility as the maneuverability is restricted by the range of a tube for transporting the viscous material to the gun. The present invention provides a backpack frame feature that transfers the weight of a supply of viscous material to a user's torso, away from the user's hand, allowing the user to comfortably carry more viscous material at a time while promoting mobility while operating the gun.

BRIEF SUMMARY OF THE INVENTION

A brief overview of the portable texture-spraying apparatus and its components follows immediately below. A more detailed description is provided in the Detailed Description of the Invention section.

The present invention provides a portable texture-spraying apparatus for uniformly dispersing a viscous material (hereinafter the "apparatus").

The apparatus broadly includes the following components: a tank assembly that has a body with an inner wall defining a sealed cavity; a piston assembly slidably disposed within the sealed cavity, where the piston assembly divides the sealed cavity into an air-side chamber and a material-side chamber by providing a sealed condition (e.g., airtight seal) therebetween, and where the material-side chamber configured to carry a supply of viscous material; and an air-control assembly for controlling air pressure within the air-side chamber. The air-control assembly broadly includes a pressure-control mechanism configured for receiving compressed air from a pressurized-air source and routing a controlled pneumatic pressure to a directional valve configured for adjusting between a dispensing mode and a loading mode. When adjusted to the dispensing mode, the directional valve routes the controlled pneumatic pressure to the air-side chamber such that the controlled pneumatic pressure biases the piston assembly toward the material-side chamber. When adjusted to the loading mode, the directional valve routes the controlled pneumatic pressure of the air-side chamber to the atmosphere such that the bias on the piston assembly toward the material-side chamber is relieved. This allows for filling the material-side chamber with viscous material from the texture-spraying type gun.

In some embodiments, the apparatus further includes the following elements: one or more tie rods laterally disposed on an outer wall of the body; a set of fasteners each having a top head, an intermediate shoulder, and a threaded portion that is threadably engaged to a tie rod of the one or more tie rods; and a top-cap assembly. The top-cap assembly includes a clamping member fixedly attached to the body, where the fixable attachment is made upon capturing the clamping member between the intermediate shoulder of at least one of the set of fasteners and the upper end of the body. The top-cap assembly also includes a removable member having a set of mounting apertures. The mounting apertures include an assembly hole intersecting with a retaining slot, where each of the set of mounting apertures corresponds to each of the set of fasteners, respectively. Each assembly hole is configured to receive the top head of a fastener of the set of fasteners. Accordingly, upon rotating the removable member to an assembled position, each retaining slot is configured to translate to be generally interdisposed between the top head and the intermediate shoulder of a fastener. In this way, the removable member is secured to the clamping member.

In other embodiments, the piston assembly includes one or more of the following features: one or more structural elements; a pair of plates sized to be accepted within the one or more structural elements; an upward-flared seal engaged with an inner wall to form an airtight seal; a downward-flared seal engaged with the inner wall to form an airtight seal; and a fastener. The controlled pneumatic pressure of the air-side chamber facilitates the airtight seal of the engagement of the upward-flared seal. The downward-flared seal is configured to scrape the inner wall such that viscous material is removed therefrom. The fastener is provided for compressing the upward-flared seal between one of the pair of plates and one of the one or more structural elements. Additionally, the fastener is for compressing the downward-flared seal between one of the pair of plates and one of the one or more structural elements. Accordingly, the compression generates curvature within the downward-flared seal and upward-flared seal.

As will be seen from the detailed description that follows, the invention provides a portable texture-spraying apparatus for uniformly dispersing a viscous material. Additional advantages, and novel features of the invention will be set forth, in part, in a description which follows and, in part, will become apparent to those skilled in the art upon examination of the following, or may be learned by practice of the invention.

BRIEF DESCRIPTION OF THE SEVERAL VIEWS OF THE DRAWING

In the accompanying drawings, which form a part of the specification, and which are to be read in conjunction therewith, and in which like reference numerals are used to indicate like parts in the various views, where thicknesses and dimensions of some components may be exaggerated for clarity.

DETAILED DESCRIPTION OF THE INVENTION

Figure 1:
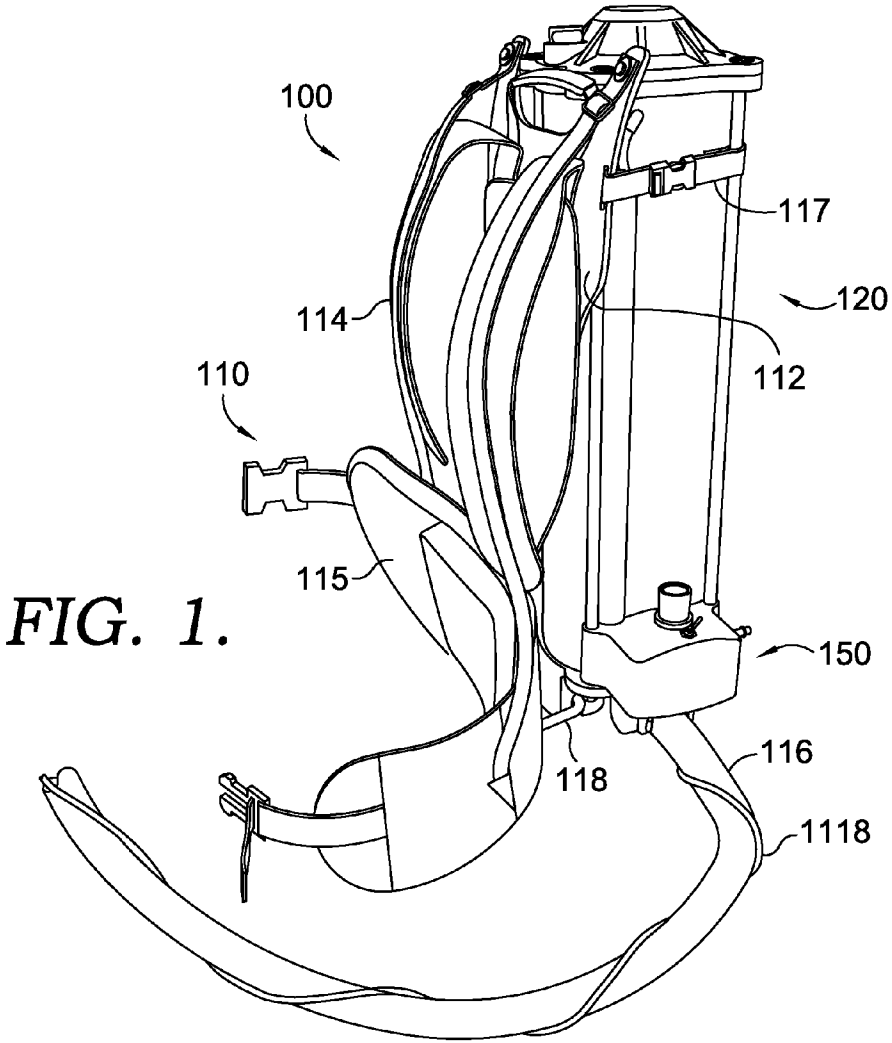
FIG. 1 is a perspective view of a portable texture-spraying apparatus, according to an embodiment of the present invention.

Referring to the drawings in greater detail and initially to FIG. 1, the embodiments of the present invention are directed toward a portable texture-spraying apparatus (hereinafter the "apparatus"), which is shown and designated generally by reference numeral 100. The apparatus 100 broadly includes, a backpack frame 110, an air-control assembly 150 with an air-tube 1118 extending therefrom, and a tank assembly 120 with a tube 116 extending therefrom.

Figure 13:
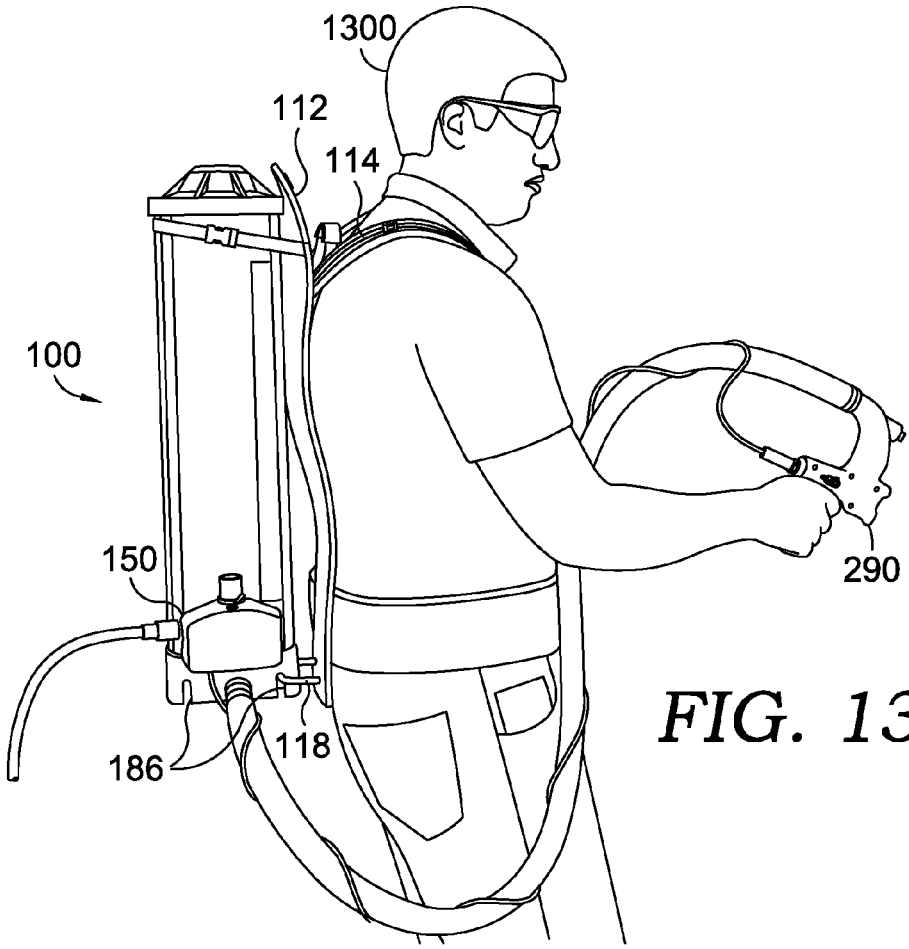
FIG. 13 is an illustrative view of the portable texture-spraying apparatus being worn by a user when operating the texture-spraying type gun, according to an embodiment of the present invention.

In one embodiment, the backpack frame 110 is configured to removably attach the tank assembly 120 to a user (not shown) to thereby improve mobility of the user when operating the apparatus 100. The backpack frame 110 includes a spine component 112, shoulder straps 114, a lower support 118, securing straps 117, and belt 115. The spine component 112, the shoulder straps 114, and the belt 115 assist in securing the backpack frame 110 to the user, as discussed more fully below with reference to FIG. 13. Further, the spine component 112, in embodiments, is formed from a metal sheet to generally conform to the shape of a human back. The spine 112 can also be formed from a composite (e.g., plastics or carbon fiber). The shoulder straps 114 and belt 115, in embodiments, are formed of a flexible material (e.g., fabric, textile material, plastic, etc.) and may have portions that hold on to a user's shoulders and waist, and/or provide support for a user's upper and lower back. Additionally, the belt 115 includes a clasping mechanism for engaging ends of the belt 115 around the user's torso. The lower support 118 and the securing straps 117 fixedly attach the tank assembly 120 to the spine component 112. In particular, the lower support 118, typically a metal u-bar, provides vertical support to the tank assembly 120 while the securing straps 117 provide lateral support to the tank assembly 120. Although one embodiment of the backpack frame 110 is illustrated and described, persons familiar with the field of carrying devices will realize that the backpack frame 110 may be practices by various devices which are different from the specific illustrated embodiment. Therefore it is emphasized that the invention is not limited only to its embodiment but is embracing of a wide variety of devices that allow the tank assembly 120 to mount to the torso (e.g., shoulders and/or waist) of a user.

Figure 2:
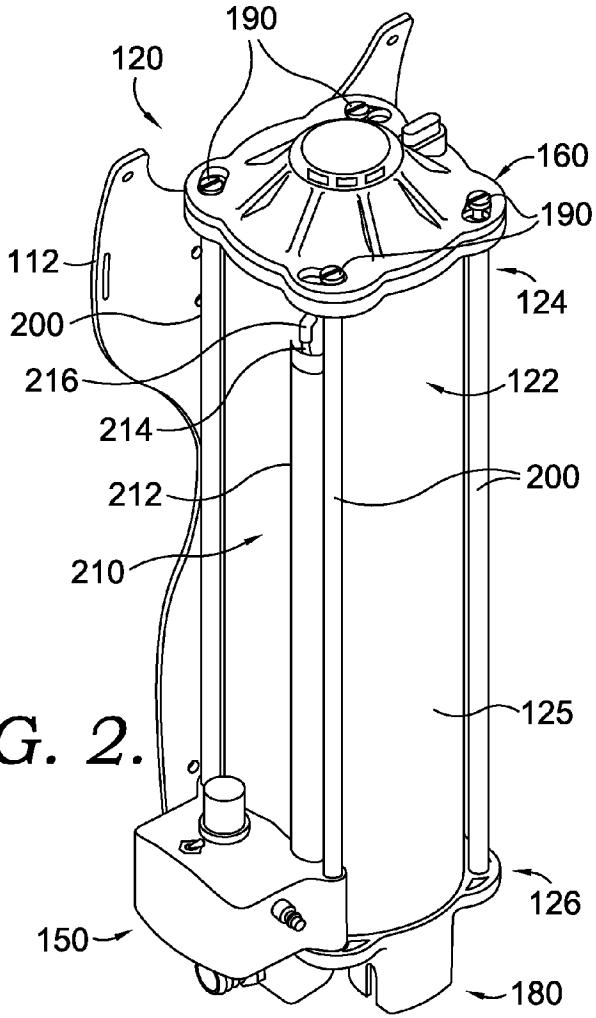
FIG. 2 is a perspective view of the portable texture-spraying apparatus of FIG. 1, with portions of the backpack frame, as well as a hose and an air-tube removed for clarity, according to an embodiment of the present invention.

Turning now to FIG. 2, a view of the tank assembly 120 that has the spine component 112 and the air-control assembly 150 attached thereto, according to an embodiment of the present invention, is provided. Broadly, the tank assembly 120 includes a top-cap assembly 160, fasteners 190, a body 122 that has an upper end 124 and a lower end 126, tie rods 200, a piston assembly 250 (see FIGS. 3 and 10), and a bottom-cap assembly 180. Typically, the top-cap assembly 160 is assembled to the upper end 124 of the body 122, while the bottom-cap assembly 180 is assembled to the lower end 126 of the body 122.

Although a single tank assembly 120 is depicted in FIGS. 1-13 and described herein, the present invention contemplates utilizing two of more interconnected tanks to form the apparatus 100. These tanks may be share a common backpack frame 110 and a common air-control assembly 150, or may each be outfitted with an individual air-control assembly 150. As such, the two or more tanks may be interconnected with the air-tube 1118 in parallel or in series.

In embodiments, the tie rods 200 are laterally disposed on an outer wall 125 of the body 122. In one instance, laterally disposed includes evenly spacing four tie rods 200 about the circumference of the outer wall 125 of the body 122. In another instance, the tie rods 200 are oriented in substantial parallel alignment with a centrally-disposed axis defined by the body 122. In addition, the tie rods 200 may be formed of any rigid material and provide internal threading at each end facilitating assembly of the fasteners 190 and mounting hardware associated with bottom-cap assembly 180 thereto. The rigidity of the tie rods 200 lends structural support to the apparatus 100 (e.g., resisting outward radial forces caused by internal pressure).

The air-control assembly 150 includes an airflow assembly 210, and various other components discussed more fully below with reference to FIGS. 11 and 12. In an exemplary embodiment, the airflow assembly 210 includes an manifold 216, a pathway 214, and a cover 212 for protecting the pathway 214 from external hazards. The manifold 216 is typically secured to the outer wall 125 of the body 122 such that the manifold 216 and an internal cavity defined by the body 122 are in fluid communication. Specifically, as more fully discussed below, the manifold 216 is positioned on the outer wall 125 such that the manifold 216 is in constant fluid communication with an air-side chamber above the piston assembly 250. In one instance, the securing of the manifold 216 is made by gluing a portion of the manifold 216 over a hole in the outer wall 125 of the body 122. In another instance, an o-ring is provided to seal the fluid communication from leakage to the atmosphere. The pathway 214 may by any component configured to transport air (e.g., air tube) between the manifold 216 and a directional valve (discussed below) of the air-control assembly 150. Accordingly, the airflow assembly 210 provides a means for routing controlled pneumatic pressure from the air-control assembly 150 to the air-side chamber.

The components mentioned above will now be discussed with more detail, with reference to FIG. 3, which is a view similar to FIG. 2, but with the components of the tank assembly 120 illustrated as exploded away each other, according to an embodiment of the present invention. Additionally, the spine component 112 and the air-control assembly 150 are depicted for purposes of describing their attachment to the tank assembly 120.

Initially, the fasteners 190 are provided to secure the top-cap assembly 160 to the upper end 124 of the body 122. In particular, the fasteners 190, as seen in more detail at FIG. 9, include a top head 920, an intermediate shoulder 922, and a threaded portion 924. The threaded portion 924 may be any standard threads known in the relevant field. The threaded portion 924 is configured to install to the internal threading at an end of the tie rod 200, as discussed above. Accordingly, the tie rods 200 may be secured to the outer wall 125 of the body 122, or independent of the body 122, where the fasteners 190 and mounting hardware secure the tie rods 200 in position. The top head 920 may include a machined texturing 926 (e.g., ridges, knurling, etc.) to facilitate fingertip installation, a slot(s) 928 for receiving a tool (e.g., screwdriver), or any other features that assist with installing the fasteners 190 to the tie rods 200. The intermediate shoulder 922 is located above the threaded portion 924 but below the top head 920 by a distance of spacing 930. As discussed more fully below, the intermediate shoulder 922 is adapted to capture the clamping member 164 against the upper end 124 of the tubular assembly 122, while the top head 920 and intermediate shoulder 922 are configured to secure the removable member 162 in the assembled position.

Returning to FIG. 3, the top-cap assembly 160 will now be described. Generally, the top-cap assembly 160 includes a clamping member 164, a removable member 162, a relief valve 166, an exhaust cap 168, a release assembly 170, and a seal 172. The clamping member 164 formed of a molded plastic or any other rigid material. As seen in greater detail at FIG. 4, the clamping member 164 includes mounting holes 412 and an inner diameter 414 that has cutouts 410 therein. The mounting holes 412 are formed and positioned around the circumference of the clamping member 164 to receive the fasteners 190. Specifically, the threaded portion 924 of the fasteners 190 is received by the mounting holes 412 while intermediate shoulder 922 contacts an upper surface 416 of the clamping member 164 when fixedly attached to the body 122. In one instance, the mounting holes 412 are formed with a counter-bore to so that the intermediate shoulder 922 is even with, or below, the upper surface 416 of the clamping member 164. In embodiments, the inner diameter 414 is configured to allow access to a cavity defined by the tank assembly 120. In one instance, the inner diameter 414 is sized to allow removal of the piston assembly 250 (see FIG. 3).

In embodiments, the seal 172 is sized to contact an inner wall 128 of the body 122, as shown in FIG. 2, such that upon rotating the removable member 162 to the assembled position, the seal 172 is compressed between the removable member 162 and the inner wall 128 creating a sealed condition (e.g., liquid seal or hermetic seal). In one instance, the seal 172 is an o-ring manufactured from a rubberized material and is held in place by a circumferential groove 505 (see FIG. 5). The cutouts 410 are configured to resist rotating the removable member 162 from the assembled position by interfering with a lower shaft portion of a locking element, as discussed more fully below with reference to FIG. 6.

Figure 4:
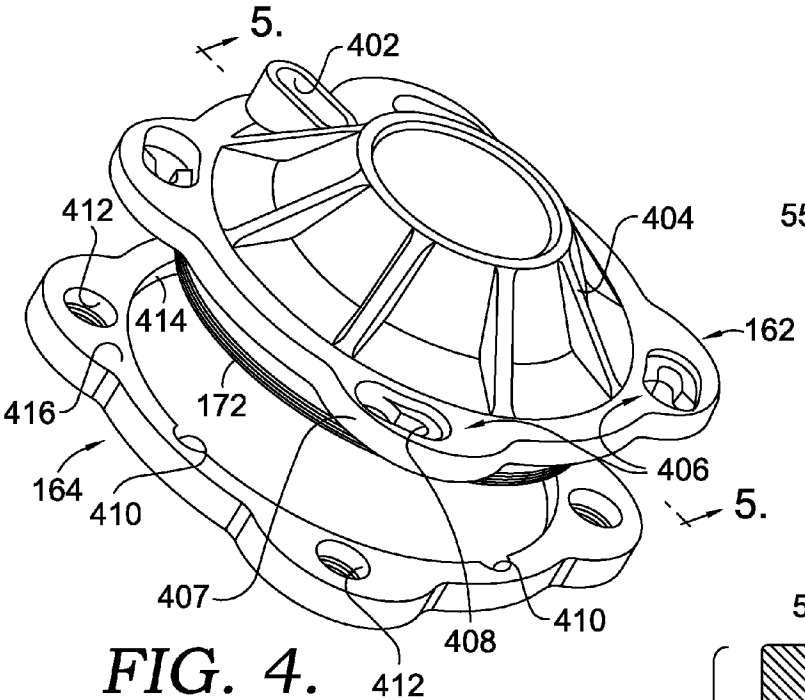
FIG. 4 is an exploded perspective view of a removable member and the clamping member, according to an embodiment of the present invention.

The removable member 162, as seen in greater detail at FIG. 4, similar to the clamping member 164, is formed of a molded plastic or any other rigid material and includes a bore 402, ridges 404, and mounting apertures 406. The bore 402 is configured to receive the lower shaft portion of the locking member, as discussed more fully with reference to FIGS. 5 and 6. The ridges 404 are molded or machined into the removable member 162 to assist a user when rotating the releasable member to and from the assembled position. The mounting apertures 406 provide a feature whereby the removable member 162 may be rotated from an assembled position and removed from the tank assembly 120 without the need to loosen or disassemble the fasteners 190 from the tie rods 200. In an exemplary embodiment, the mounting apertures 408 include an assembly hole 407 intersecting with a retaining slot 408.

Figure 9:
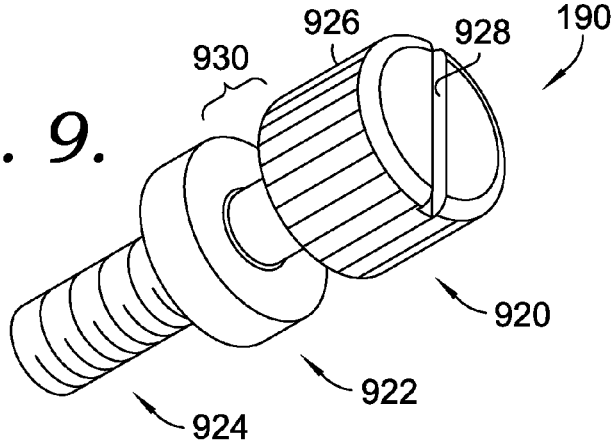
FIG. 9 is an enlarged perspective view of a fastener, according to an embodiment of the present invention.

The operation of installing the removable member 162 will now be discussed with reference to FIGS. 3, 4, and 9. Initially, the fasteners 190 are installed into the tie rods 200 such that the clamping member 164 is fixedly attached to the upper end 124 of the tubular assembly 122. The assembly holes 407 may be then aligned over the top heads 920. Typically, the outer diameter of each top head 920 is sized to be received by any of the assembly holes 407. Next, the removable member 162 is placed adjacent to the upper surface 416 of the clamping member 164. The removable member 162 can then be rotated, with the help of the ridges 404, to the assembled position (as depicted in FIG. 2). During rotation, the retaining slots 408 translate to be generally interdisposed between the intermediate shoulder 922 and top head 920 of the fasteners 190. Accordingly, the material surrounding the retaining slots 408 is formed to insert within the spacing 930. In the assembled position, the removable member 162 is assembled to the clamping member 164 and, accordingly, provides an airtight seal therewith.

Figure 5:
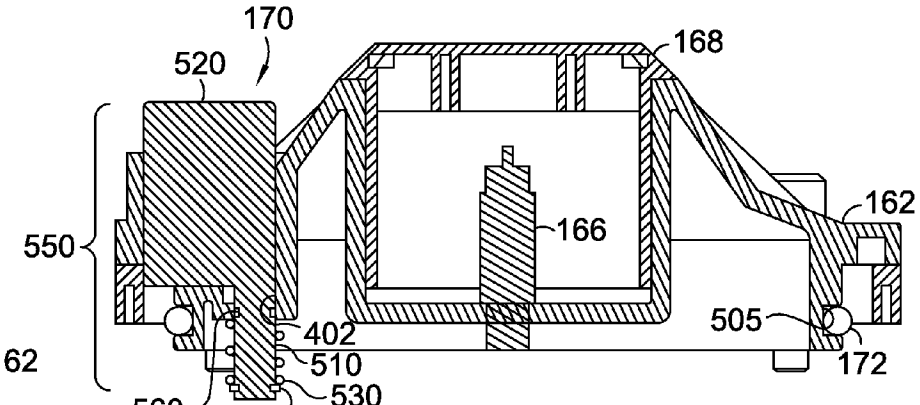
FIG. 5 is a cross-sectional view of a top-cap assembly featuring a locking element in the sealed condition taken along line 5-5, according to an embodiment of the present invention.
Figure 8:
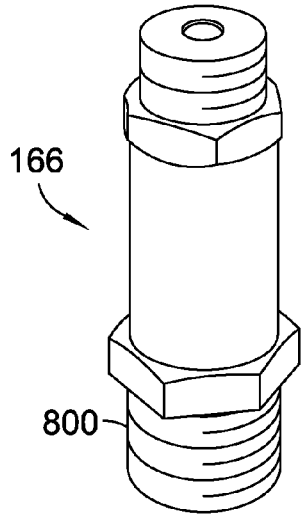
FIG. 8 is an enlarged perspective view of a relief valve, according to an embodiment of the present invention.

Returning to FIG. 3, the relief valve 166, the exhaust cap 168, and the release assembly 170 will now be described. The relief valve 166 functions to relieve internal pressure within the tank assembly 120 upon the level of internal pressure exceeding a predefined threshold. By way of example only, the predefined threshold may be set at 15 PSI. Accordingly, the relief valve 166 operates to bleed air to atmosphere when relieving excess pressure, but creates a seal against leakage when the internal pressure is below the predefined threshold. With reference to FIGS. 5 and 8, in embodiments, the relief valve 166 includes a threaded portion 800 for assembly to the top-cap assembly 160. In particular, the relief valve 166 may be assembled to the removable member 162 in a generally vertical orientation.

Returning to FIG. 3, the exhaust cap 168 serves to protect the relief valve 166 and will allow air escaping therefrom to reach the atmosphere. Similar to the removable member 162 and the clamping member 164, the exhaust cap 168 may be formed of a formed of a molded plastic or any other rigid material capable of providing protection for the relief valve 166. With reference to FIG. 5, in embodiments, the exhaust cap 168 is shaped to substantially surround the relief valve 166 and to couple to the removable member 162. Coupling may be may by press fit, adhesive means, or any other method of attachment known in the relevant field.

Returning to FIG. 3, and with additional reference to FIGS. 5, 6, and 7, the release assembly 170 will now be discussed in detail and operation. The release assembly 170 includes a locking element 550 that has an upper tab portion 520 and a lower shaft portion 510, a compression spring 530, an o-ring 560, and a retaining clip 540 coupled to the lower shaft portion 510. In one instance, this coupling may be facilitated by providing the lower shaft portion 510 with a circumferential groove 720 to prevent the retaining clip 540 from traveling thereon. By way of example, the retaining clip 540 may be a snap ring, pin, or any other suitable hardware. The retaining clip 540 serves to engage one end of the compression spring 530. The other end of the compression spring 530 is engaged by the removable member 162. Although shown and described as a spring, the present invention contemplates utilizing any outward biasing element as the compression spring 530. The o-ring 560 is typically assembled to the lower shaft portion 510 of the locking element 550 and may be any style of seal know in the relevant field art. In one instance, this assembly may be facilitated by providing the lower shaft portion 510 with a circumferential groove 730 to prevent the o-ring 560 from traveling thereon.

The release assembly 170 is provided to perform a variety of functions. One of these functions is to manually relieve internal pressure captured within the tank assembly 120. Another of these functions is to provide a sequencing device that arrests the rotation of the removable member 162 from the assembled position without first attempting to relieve internal pressure. Other functions will be apparent from the FIGS. 5 and 6, and from the discussion hereinbelow.

In particular, the release assembly 170 is configured to enable the locking element 550 to move between a sealed condition and a release condition. The sealed condition, as shown in FIG. 5, is the state in which the locking element 550 naturally resides. In the sealed condition, a downward bias provided by the compression spring 530 extends the lower shaft portion 510 through the bore 402, which is slidably engaged thereto. When extended, the o-ring 560 contacts the removable member 162 thereby providing an airtight seal that conserves an internal pressure within the tank assembly 120 (see FIG. 3). Also, while in the sealed position, the lower shaft portion 510 is partially confined by the cutout 410 of the clamping member 164 (see FIG. 4). As such, this partial confinement resists rotation of the removable member 162 from the assembled position.

Figure 6:
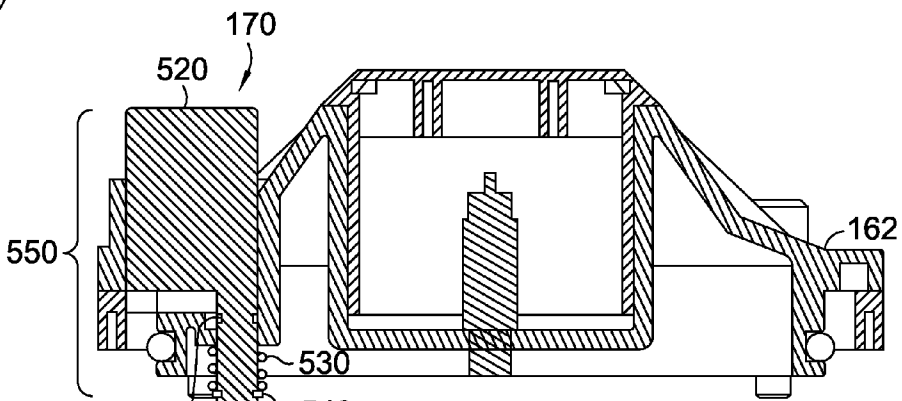
FIG. 6 is a view similar to FIG. 5, but with the locking element in the released condition, according to an embodiment of the present invention.
Figure 7:
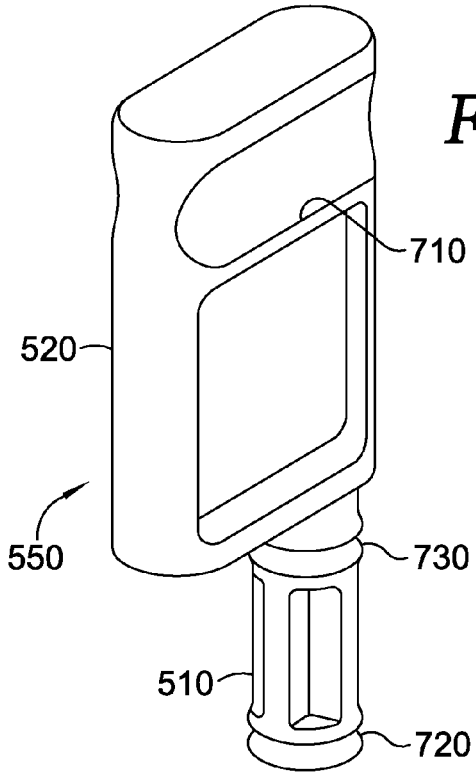
FIG. 7 is an enlarged perspective view of the locking element, according to an embodiment of the present invention.

The released condition, as shown in FIG. 6, is the state in which the locking element 550 is moved upward from the sealed position. In the released condition, an upward force sufficient to overcome the downward bias provided by the compression spring 530 is applied to the upper tab portion 520 of the locking element 550. Typically, the upward force is manually exerted by a user. To assist in manually exerted the upward force, ridged texturing 710 (see FIG. 7) may be provided on the upper tab portion 520. Accordingly, the lower shaft portion 510 retracts through the bore 402 in the removable member 162. When retracted, the o-ring 560 is displaced from the removable member 162 thereby abating any internal pressure within the tank assembly 120 (see FIG. 3). Also, while in the released position, the lower shaft portion 510 is not confined by the cutout 410 of the clamping member 164 (see FIG. 4). As such, the removable member 162 is allowed to rotate from the assembled position for removal.

Figure 3:
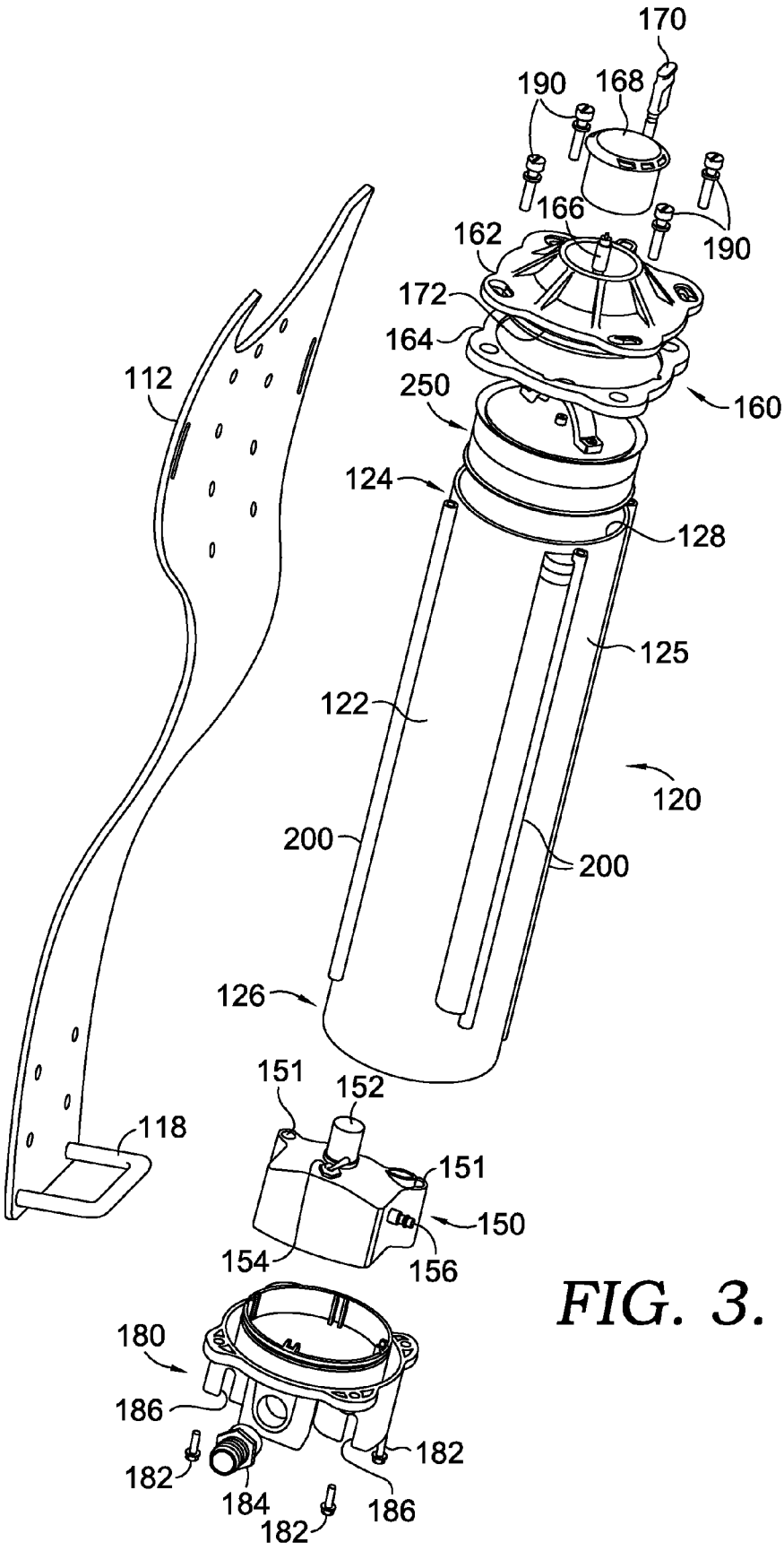
FIG. 3 is an exploded view of the portable texture-spraying apparatus of FIG. 2, according to an embodiment of the present invention.

With reference to FIG. 3, the body 122 will now be discussed. Typically, the body 122 is formed from a sturdy lightweight material (e.g., PVC pipe) or any material that resists structural deformation, in cooperation with the tie rods 190, when pressurized internally. As previously mentioned, the body 122 includes the upper end 124, the lower end 126, and the outer wall 125. In addition, the body 122 includes an inner wall 128 that defines a sealed cavity, where the tank assembly 120 circumscribes the sealed cavity. In embodiments, the inner wall 128 has a substantially cylindrical smooth surface that is in slidably engagement with the piston assembly 250. In other embodiments, the inner wall 128 is configured as another geometric shape, such as a rectangle, square, oval, etc. Although several exemplary shapes have been described with reference to the inner wall 128, it should be appreciated and understood that the present invention is not limited to a particular cross-sectional shape, but may be any rounded shape, any polygonal shape, or any combination thereof.

The piston assembly 250 is adapted to move axially and thus longitudinally traverse the inner wall 128 when filling the body 122 with viscous material, when spraying viscous material, or when removing the piston assembly 250 (e.g., for cleaning the tubular assembly 122). Grease, or any other lubricating fluid, may be applied to the inner wall 128 to aid the longitudinal traversal of the piston assembly 250. In an exemplary embodiment, as discussed above, the piston assembly 250 is resides in sealed cavity defined by the inner wall 128. In addition, the piston assembly is provided to divide the sealed cavity into an air-side chamber 1202 and a material-side chamber 1204, where the air-side chamber 1202 is configured to conserve controlled pneumatic pressure 1206 while the material-side chamber 1204 is configured to carry a supply of viscous material 1208 (see FIG. 12). The piston assembly 250 creates this division by making an airtight seal against the inner wall 128 of the body 122.

Figure 10:
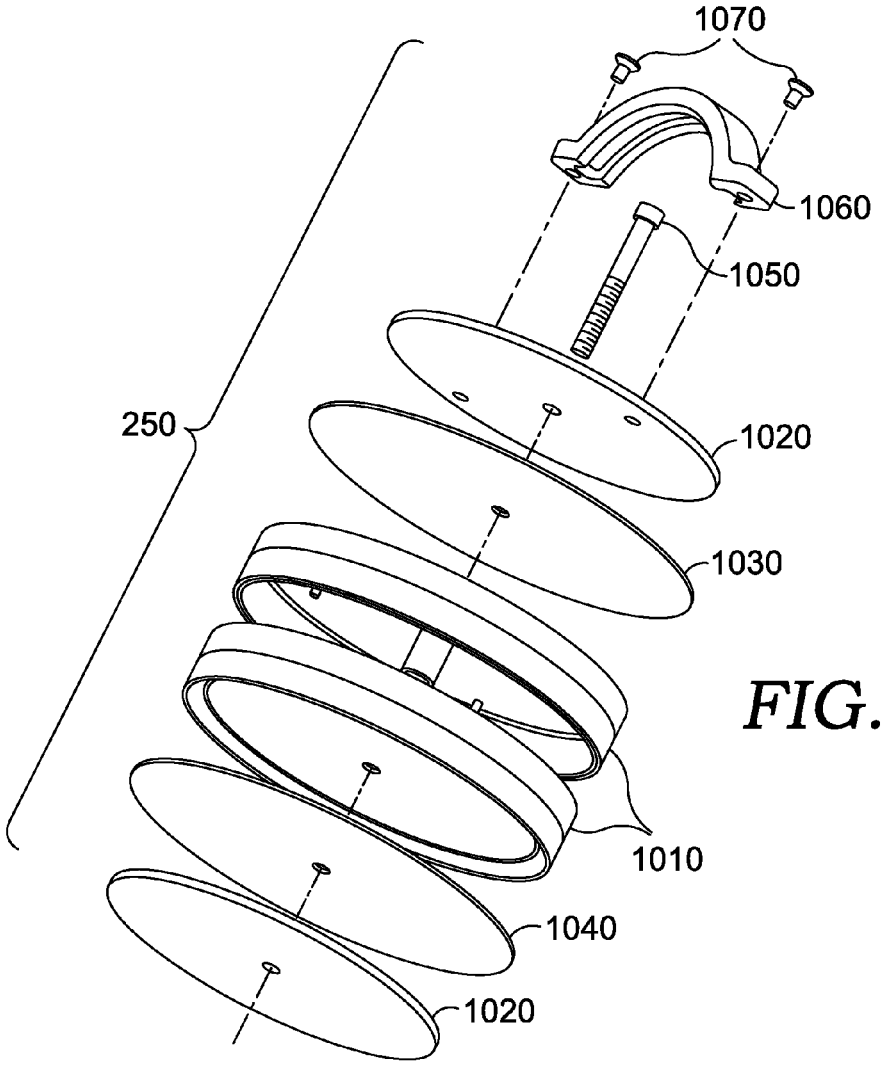
FIG. 10 is an exploded perspective view of a piston assembly, according to an embodiment of the present invention.

In particular, the configuration of the components of the piston assembly 250 is significant in achieving this airtight seal. With reference to FIG. 10, the components include one or more substantially cylindrical structural elements 1010, a pair of substantially circular plates 1020, an upward-flared seal 1030, a downward flared seal 1040, a fastener 1050, and a handle 1060 coupled to one of the pair of circular plates 1020 via hardware 1070. Typically, the handle 1060 is provided to assist a user in removing the piston assembly 250 for cleaning. Optionally, an air passage (not shown) with a sealing mechanism (e.g., check valve) is provided axially through the piston assembly 250 to reduce any vacuum created when manually removing the piston assembly 250. The fastener 1050 is provided for compressing the upward-flared seal 1030 (e.g., neoprene rubber round disc) between one of the pair of substantially circular plates 1020 and one of the structural elements 1010. In addition, the fastener 1050 compresses the downward-flared seal 1040 (e.g., neoprene rubber round disc) between one of the pair of substantially circular plates 1020 and one of the structural elements 1010. In one embodiment, the structural elements 1010 have a common radius that is greater than the radius of the circular plates 1020 such that the circular plates 1020 can accepted within the structural elements 1010. Accordingly, upon compression of the piston assembly this configuration of the components generates curvature within the seals 1030 and 1040.

In particular, the downward-flared seal 1040 is beveled downward and engaged with the inner wall 128 (see FIG. 3) to form a hermetic seal therewith. The engaged portion of the downward-flared seal 1040 is configured to scrape the inner wall 128 (see FIG. 3) such that viscous material 1208 (see FIG. 11) is removed therefrom. Also, the hermetic seal of the downward-flared seal 1040 assists in maintaining the supply of viscous material 1208 (see FIG. 11) in a liquid state for an extended period of time. Additionally, the upward-flared seal 1030 is beveled upward circumferentially engaged with inner wall 128 (see FIG. 3) to form a hermetic seal therewith. Further, the controlled pneumatic pressure 1206 of the air-side chamber 1202 (see FIG. 11) acts to strengthen the hermetic seal by pneumatically pressing the engaged portion of the upward-flared seal 1030 against the inner wall 128.

Returning to FIG. 3, the air-control assembly 150 and bottom-cap assembly 180 are depicted exploded from the tank assembly 120. The air-control assembly 150 mounts the tank assembly by aligning mounting bore(s) 151 with at least one of the tie rods 200. The mounting hardware 182 concurrently assembles the air-control assembly 150 to the tank assembly 120 and fixedly attaches the bottom-cap assembly 180 to the lower end 126 of the body 122. When fixedly attached, the bottom-cap assembly 180, along with the inner wall 128 of the body 122 and the piston assembly 250, define the material-side chamber 1204 (see FIG. 12). In some embodiments, the bottom-cap assembly 180 includes longitudinally extending piston-stop elements (not shown) that contact the substantially circular plate 1020 of the piston assembly 250 to prevent the downward-flared seal 1040 from interfering with any portion of the bottom-cap assembly 180. In this way, the downward-flared seal 1040 is protected from repeated interference that may cause tearing, wear, or other compromising damage.

In an exemplary embodiment, the bottom-cap assembly 180 includes slots 186 for receiving the lower support 118 coupled to the spine component 112. As discussed above, the lower support 118 provides vertical support to, and rotationally stabilizes, the tank assembly 120. Additionally, the lower support 118 is configured to be received by either of the slots 186. This allows for the apparatus 100 to be specifically configured for the dominant hand of any user. For instance, with reference to FIG. 3, when worn by a user, the air-control assembly 150 and controls thereon are accessible to the user's left hand. Alternatively, with reference to FIG. 13, the apparatus 100 is being worn by the user 1300, where the shoulder straps 114 hold to the user's shoulders and the spine component 112 rests against the user's back, such that the air-control assembly is accessible to the user's 1300 right hand. Accordingly, the lower support 118 is received in a slot 186 different than above. Additionally, with continued reference to FIG. 13, the user's 1300 dominant hand also naturally operates the texture-spraying type gun 290.

Figure 11:
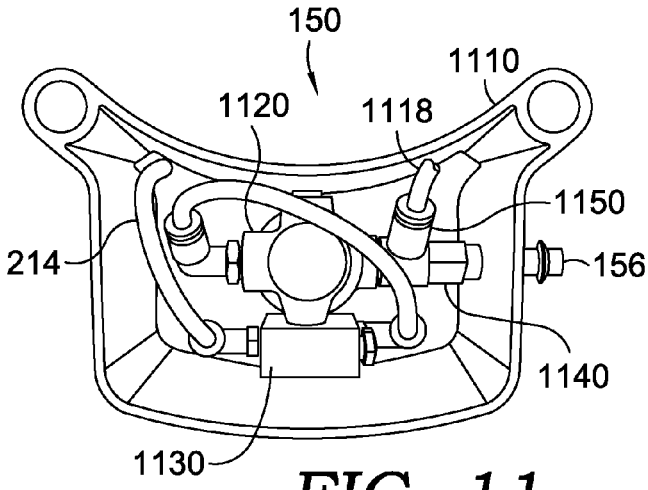
FIG. 11 is a rear take out view of internal components of the air-control assembly, according to an embodiment of the present invention.
Figure 12:
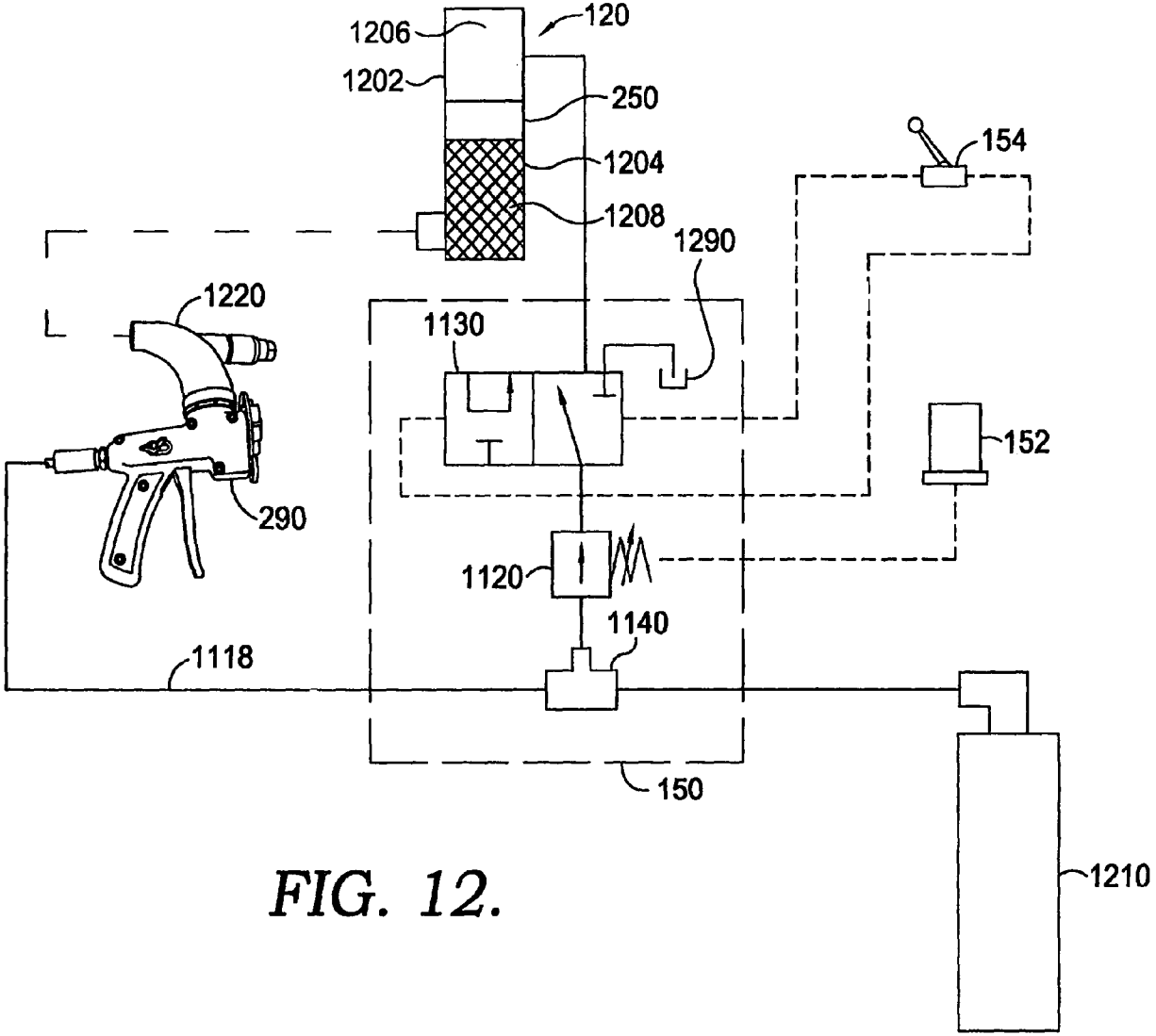
FIG. 12 is a schematic illustration depicting functions of components of the air-control assembly as fluidly connected to a pressurized-air source, the tank assembly, and a texture-spraying type gun, according to an embodiment of the present invention.

With reference to FIGS. 3, 11, and 12, the air-control assembly 150 will be considered both in structure and function. The air-control assembly 150 generally includes a pressure-inlet fitting 156, a tee-junction element 1140, a full-line pressure outlet fitting 1150 connected to the texture-spraying type gun 290 via the air-tube 1118, a pressure-control mechanism 1120, a directional valve 1130, and the airflow assembly 210 (discussed above with reference to FIG. 2). The order of the listing of components above coincides with the flow of air from a pressurized air source 1210 (e.g., air compressor) to the tank assembly 120. Additionally, a housing 1110 may be provided for protecting these components from external hazards. Although not described herein, the components above are communicably interconnected by pressure lines. The pressure lines are typically a flexible lightweight material suitable to withstand pressurized air.

In embodiments, the pressure-control mechanism 1120 is controllably adjusted by a control knob 152. Controllable adjustment may be made by may be made by mechanical, electrical, or fluid means (as shown by the phantom lines in FIG. 12). The control knob 152 may provide continuous or intervallic controllable adjustment of the pressure-control mechanism 1120 over a range of pressures (e.g., 0-15 PSI). Accordingly, this controllable adjustment directly determines the controlled pneumatic pressure 1206 in the air-side chamber 1202. Any variations of the controlled pneumatic pressure 1206 affects a rate of downward advancement of the piston assembly 250, thereby increasing or decreasing the uniform dispersion of viscous material 1208. The compressed air that is not consumed by the pressure-control mechanism 1120 is diverged via the tee-junction element 1140 to the texture-spraying type gun 290.

Figure 14:
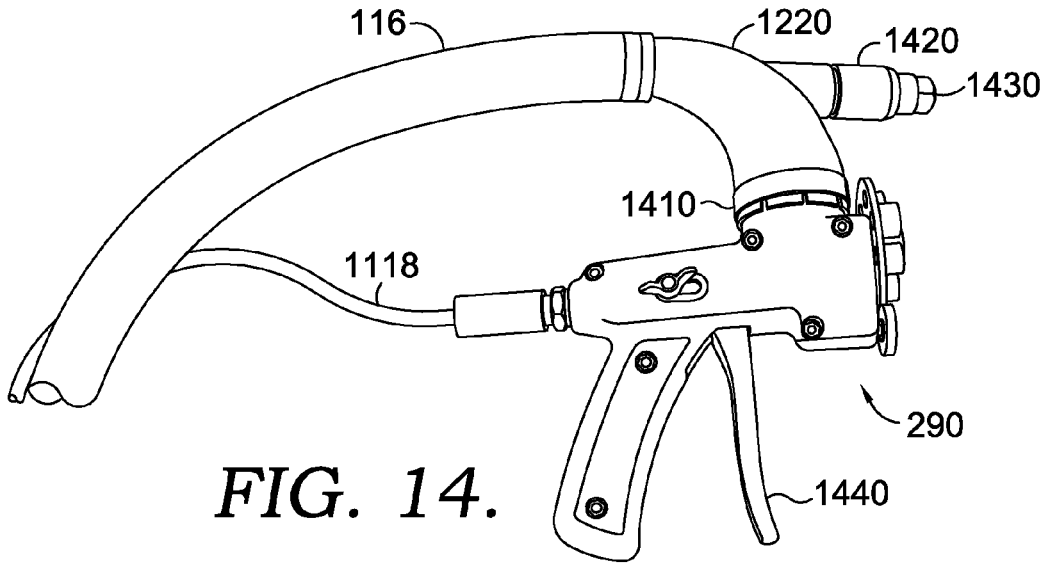
FIG. 14 is a side view of the texture-spraying type gun assembled to a fill fitting, according to an embodiment of the present invention.

Next, the uniform dispensing operation and the filling operation of the apparatus 100 will be discussed with reference to FIG. 11. As discussed above, the pressure-control mechanism 1120 is configured for receiving compressed air from the pressurized-air source 1210 and routing a controlled pneumatic pressure 1206 to the directional valve 1130. The directional valve 1130 is configured for adjusting between a dispensing mode and a loading mode. Adjustment may by achieved by manually actuating a switch 154 (e.g., two-position toggle switch) that is controllably linked to the directional valve 1130. This controllable link (as shown by the phantom lines in FIG. 12) may be made by mechanical, electrical, or fluid means. When adjusted to the dispensing mode, the directional valve routes 1130 the controlled pneumatic pressure 1206 to the air-side chamber 1202 such that the controlled pneumatic pressure biases the piston assembly 250 toward the material-side chamber 1204. Accordingly, the viscous material 1208 is uniformly dispensed from the tank assembly 120 through a fitting 184 (see also FIG. 3) that is in fluid connection with the tube 116 (see FIG. 1). The tube 116 transports the viscous material 1208 to a texture gun adapter 1220 that feeds the viscous material 1208 into the texture-spraying type gun 290 via coupling 1410. As depicted in FIG. 14, the texture-spraying type gun 290 receives compressed air via air-tube 1118 as well as the uniformly dispensed viscous material 1208. These fluids are mixed within the texture-spraying type gun 290 upon depression of trigger 1440. Trigger 1440 depression results in a valve (not shown) opening to allow the compressed air to flow into the body of the texture-spraying type gun 290 from the air-tube 1118 for mixing with the viscous material 1208. Accordingly, trigger 1440 depression results in the delivery of viscous material 1208 to a support surface (not shown) in the form of a controlled texturing spray from a nozzle of the texture-spraying type gun 290.

Returning to FIG. 12, when adjusted to the loading mode, the directional valve routes 1130 the controlled pneumatic pressure 1206 of the air-side chamber 1202 to the atmosphere 1290 such that the bias on the piston assembly 250 toward the material-side chamber 1204 is relieved. This allows for filling the material-side chamber 1204 with viscous material 1208. In one embodiment, with reference to FIGS. 12 and 14, filling is achieved by removing cap 1430 from fitting 1420 on the texture gun adapter 1220 and coupling a hand pump thereto. With the controlled pneumatic pressure 1206 relieved from the air-side chamber 1202, viscous material 1208 may easily be pumped through the fitting 1420 and into the material-side chamber 1204 via the tube 116. In this way, the tank assembly 120 may be loaded with viscous material 1208 without having to disassemble any components thereof, or even remove the tank assembly 120 from the back of the user. Although the fitting 1420 and cap 1430 are illustrated and described, any components for opening and closing a path to the texture gun adapter 1220 is contemplated by the present invention, including a ball valve, check valve, or quick-disconnect coupling.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A portable texture-spraying apparatus having a tank assembly for providing a user access thereto, the tank assembly comprising:

a body with an inner wall and an outer wall, wherein the body has an upper end and a lower end;

a piston assembly slidably engaged to the inner wall forming a hermetic seal therewith, one or more tie rods laterally disposed on the outer wall of the body;

a set of fasteners each having a top head, an intermediate shoulder, and a threaded portion that is threadably engaged to a tie rod of the one or more tie rods; and a top-cap assembly, wherein the top-cap assembly, the inner wall of the body, and the piston assembly define an air-side chamber, the top-cap assembly comprising:

(1) a clamping member fixedly attached to the body, wherein the fixable attachment is made upon capturing the clamping member between the intermediate shoulder of at least one of the set of fasteners and the upper end of the body;

(2) a removable member having a set of mounting apertures, the mounting apertures comprising an assembly hole intersecting with a retaining slot, wherein each of the set of mounting apertures corresponds to each of the set of fasteners, respectively; and (3) a seal compressed between the removable member and the inner wall of the body such that, upon rotating the removable member to an assembled position, the air-side chamber is rendered sealed;

wherein each assembly hole is configured to receive the top head of a fastener of the set of fasteners, wherein upon rotating the removable member to the assembled position each retaining slot is configured to translate to be generally interdisposed between the top head and the intermediate shoulder of one or more of the set of fasteners, thereby securing the removable member to the clamping member.

2. The tank assembly of claim 1, further comprising a bottom-cap assembly fixedly attached to the lower end of the body, wherein the bottom-cap assembly, the inner wall of the body, and the piston assembly define a material-side chamber adapted to carry a supply of viscous material.

3. The tank assembly of claim 2, wherein the material-side chamber is airtight such that the supply of viscous material remains viscous over an extended period.

4. The tank assembly of claim 2, wherein the bottom-cap assembly comprises longitudinally extending piston-stop elements for resisting downward movement of the piston element.

5. The tank assembly of claim 1, wherein the top-cap assembly further comprises a relief valve configured to release internal pressure of the airtight air-side chamber to the atmosphere upon the internal pressure reaching a threshold setting of the relief valve.

6. The tank assembly of claim 5, further comprising a release assembly, the release assembly comprising a locking element having an upper tab portion and a lower shaft portion, a compression spring, and retaining clip fixedly attached to the lower shaft portion of the locking element.

7. The tank assembly of claim 6, wherein the removable member includes a bore for receiving the lower shaft portion of the locking element in slidable engagement with the bore, wherein the compression spring is captured between the removable member and the retaining clip.

8. The tank assembly of claim 7, wherein the release assembly is configured to enable the compression spring to provide a downward bias on the locking element such that the locking element naturally resides in a sealed condition, wherein the sealed condition conserves the internal pressure of the airtight air-side chamber and resists rotation of the removable member from the assembled position.

9. The tank assembly of claim 8, wherein the release assembly is configured such that upon an upward force being exerted on the locking element sufficient to overcome the downward bias of the compression spring, the locking element moves to a released condition, wherein the released condition abates the internal pressure of the airtight air-side chamber and allows rotation of the removable member from the assembled to position.

10. A portable texture-spraying apparatus for uniformly dispersing a viscous material, the apparatus comprising:

a tank assembly having a body with an inner wall defining a sealed cavity, wherein the tank assembly encloses the sealed cavity;

a piston assembly slidably disposed within the sealed cavity, the piston assembly dividing the sealed cavity into an air-side chamber and a material-side chamber by providing an airtight seal therebetween, the material-side chamber configured to carry a supply of viscous material;

said tank assembly further comprising a top-cap assembly comprising a removable member having a set of mounting apertures each configured to receive a fastener secured to the body and a seal compressed between the removable member and the inner wall of the body such that, wherein upon rotating the removable member to an assembled position, each fastener is configured to be generally disposed within a mounting aperture, securing the removable member to the tank assembly, and the air-side chamber is rendered sealed;

an air-control assembly for controlling air pressure within the air-side chamber;

and a backpack frame for supporting the texture-spraying apparatus above an underlying surface, the backpack frame comprising:

(1) a spine component that generally conforms to a user's back and is releasably attached to the tank assembly, and (2) one or more straps coupled to the spine component that facilitate securing the tank assembly to the user.

* * * * *